US005943644A

United States Patent [19]

Yamane et al.

[11] Patent Number: 5,943,644

[45] Date of Patent: Aug. 24, 1999

[54] SPEECH COMPRESSION CODING WITH DISCRETE COSINE TRANSFORMATION OF STOCHASTIC ELEMENTS

[75] Inventors: Jun Yamane; Hiroki Uchiyama, both of Yokohama, Japan

[73] Assignee: Ricoh Company, Ltd., Tokyo, Japan

[21] Appl. No.: 08/877,710

[22] Filed: Jun. 18, 1997

[30] Foreign Application Priority Data

| | | | |
|---|---|---|---|
| Jun. 21, 1996 | [JP] | Japan | 8-162151 |
| Aug. 13, 1996 | [JP] | Japan | 8-213566 |
| Sep. 30, 1996 | [JP] | Japan | 8-258833 |

[51] Int. Cl.[6] ..... G10L 9/04

[52] U.S. Cl. ..... 704/207; 704/219; 704/222; 704/232; 704/203

[58] Field of Search ..... 704/219, 233, 704/222, 223, 207, 229, 203, 217

[56] References Cited

U.S. PATENT DOCUMENTS

| | | | |
|---|---|---|---|
| 5,091,945 | 2/1992 | Kleijn | 704/222 |
| 5,261,027 | 11/1993 | Taniguchi et al. | 704/200 |
| 5,432,883 | 7/1995 | Yoshihara | 704/219 |
| 5,448,683 | 9/1995 | Naitoh | 704/203 |
| 5,457,783 | 10/1995 | Chhatwal | 704/219 |
| 5,473,727 | 12/1995 | Nishiguchi et al. | 704/222 |
| 5,579,433 | 11/1996 | Jarvinen | 704/219 |
| 5,583,963 | 12/1996 | Lozach | 704/219 |
| 5,602,961 | 2/1997 | Kolesnik et al. | 704/223 |
| 5,657,419 | 8/1997 | Yoo et al. | 704/223 |
| 5,682,407 | 10/1997 | Funaki | 375/240 |
| 5,699,483 | 12/1997 | Tanaka | 704/219 |
| 5,717,834 | 2/1998 | Chhatwal | 704/222 |
| 5,727,122 | 3/1998 | Hososda et al. | 704/223 |
| 5,729,655 | 3/1998 | Kolesnik et al. | 704/223 |
| 5,742,733 | 4/1998 | Jarvinen | 704/220 |

OTHER PUBLICATIONS

James OOI, et al., "A Computationally Efficient Wavelet Transform CELP Coder",1994 IEEE, pp. II–101 to II–104.

Manfred R. Schroeder et al., "Code–Excited Linear Prediction (CELP):High–Quality Speech at Very Low Bit Rates", 1985 IEEE, pp. 937–940.

*Primary Examiner*—David R. Hudspeth
*Assistant Examiner*—Vijay B. Chawan
*Attorney, Agent, or Firm*—Oblon, Spivak, McClelland, Maier & Neustadt, P.C.

[57] ABSTRACT

A digital speech waveform is divided into frames and sub-frames. Spectrum envelope information, pitch elements and stochastic elements are extracted and coded for the frames and sub-frames. A second error signal is calculated as a result of subtracting, from the sub-frames, pitch component speech generated from the pitch elements and spectrum envelope elements. The second error signal is coded so as to obtain the stochastic elements as a result of transforming the second error signal into a signal of a frequency domain through discrete cosine transformation and coding coefficients of the transformed domain.

39 Claims, 6 Drawing Sheets

SPEECH COMPRESSION CODING WITH DISCRETE COSINE TRANSFORMATION OF STOCHASTIC ELEMENTS

BACKGROUND OF THE INVENTION

1. Field of the Invention

The present invention relates to a speech compression coding device which is applied to a phone answering system, a voice response system, voice mail and so forth. In detail, the present invention relates to a speech compression coding device which receives an analog speech waveform, converts it into a digital speech waveform, codes the digital speech waveform with a predetermined coding method and thus compresses the amount of data representing the speech.

2. Description of the Related Art

Recently, there has been a need for enlargement of channel capacity of vehicular communications such as that using mobile telephone systems and storage and transmission of very large amounts of information in multimedia communication. Accordingly, practical low bit-rate speech coding is needed Further, as an additional function of a facsimile modem, development of a speech coding method for a phone answering system is needed.

Currently, a CELP (Code Excited Linear Prediction) coding system has been mainly used, as a low bit-rate speech compression coding system of not more than 10 kbps. The CELP coding system is a coding system based on speech AR (Auto-Regressive) models based on linear prediction.

Specifically, on a coding side, a speech signal is divided into frames or sub-frames. Then, for each unit, LPC (Linear Prediction Coding) coefficients which represent the spectrum envelope, a pitch lag which represents pitch elements, stochastic elements and gains are extracted. Each extracted information is coded and stored or transmitted.

On a decoding side, each coded information is decoded, an excitation vector signal is generated as a result of adding the pitch elements to the stochastic elements. The excitation vector signal passes through a linear prediction synthesis filter which is formed using the LPC coefficients. Thus, synthetic speech is obtained.

However, in the CELP coding system of the prior art, although good speech can be obtained at a low bit rate of 10 kbps, the amount of calculation required for extracting and coding each parameter is large.

In particular, with regard to extracting and coding of pitch lag and extracting and coding of stochastic elements, it is necessary to generate synthetic speech by causing an excitation vector signal to pass through a linear prediction synthesis filter and compare the synthetic speech with the original speech. However, because a large amount of calculation is necessary for the filter operation, it is unpractical to cause all excitation vector signals to pass through the filter.

Further, in the CELP coding system in the prior art, a codebook for a second error signal is provided. A second error signal is synthesized from each code vector of the codebook and the spectrum envelope. Then, the synthesized second error signal is compared with the second error signal obtained from an input signal. The code vector by which distortion of the synthesized second error signal from the second error signal of the input signal is at a minimum is selected. Thus, extracting and coding is performed. However, in this method, a large amount of calculation for the codebook search and a large storage capacity of memory for storing the codebook are needed.

As prior art for reducing the amount of calculation in the CELP coding system, a pre-selection method has been proposed. The method uses a parameter by which an approximate comparison with original speech can be conducted without performing a filter operation so that the number of candidate code vectors is reduced. Then, the filter operation is performed on the reduced number of candidate code vectors, and thus, one of the code vectors is selected.

Further, generally speaking, a random codebook includes the number of stochastic vectors for a given number of bits. A method for reducing an amount of calculation by devising the arrangement has been proposed. Specifically, for example, in the VSELP (Vector Sum Excited Linear Prediction) coding system, the number of stochastic vectors which is the same as the number of bits are provided. Then, adding and/or subtracting these stochastic vectors with each other, various stochastic vectors can be obtained.

However, a practical low bit-rate speech coding is needed, methods for reducing the amount of calculation are needed other than the methods in the prior art of reducing the amount of calculations such as a preliminary selecting method, a VSELP coding method and so forth.

SUMMARY OF THE INVENTION

The present invention has been devised in consideration of the above-mentioned demand. An object of the present invention is to provide a speech compression coding method and a speech compression coding device in which, during the process of extracting and coding parameters according to the CELP system, the amount of calculation can be reduced and memory storage capacity can be reduced.

For achieving the object of the present invention, a speech compression coding according to the present invention receives an analog speech waveform and converting it into a digital speech waveform; codes the digital speech waveform in a predetermined coding method; stores the coded digital speech waveform; takes the stored coded digital speech waveform and decodes it; and converts the decoded digital speech waveform into an analog speech waveform. In the coding, the digital speech waveform is divided into frames or sub-frames; and spectrum envelope elements, pitch elements and stochastic elements are extracted for each of the frames or sub-frames. In the decoding, the coded spectrum envelope elements, pitch elements and stochastic elements are decoded; an excitation vector signal is generated from the decoded stochastic elements and pitch elements; and synthetic speech is generated from the excitation vector signal and the decoded spectrum envelope elements. In the extracting and coding, a second error signal is calculated as a result of subtracting, from the frame or sub-frame, pitch component speech generated from the pitch elements and spectrum envelope elements; and the second error signal is coded so as to obtain the stochastic elements as a result of transforming the second error signal into a signal of a frequency domain through discrete cosine transformation and coding coefficients of the transformed domain.

In this arrangement, a second error signal is calculated as a result of subtracting, from the frame or sub-frame, pitch component speech generated from the pitch elements and spectrum envelope elements. Then, using the second error signal, the stochastic element extraction and coding is performed. Thereby, in a process of the CELP coding system, a calculation amount can be reduced and also, a memory capacity can be reduced. Further, the second error signal is coded so as to obtain the stochastic elements as a result of transforming the second error signal into a signal of a frequency domain through discrete cosine transformation and coding coefficients of the transformed domain. Thus, because frequency characteristics are coded, it is possible to code the second error signal with a few bits. Further, by using the discrete cosine transformation, coding at high speed with a small amount of calculation can be achieved.

It possible to use discrete Fourier transformation instead of discrete cosine transformation when transforming the second error signal into a signal of the frequency domain. Thereby, coding at high speed with a small amount of calculation can be achieved.

It also possible to use K-L (Karhunen-Loeve) transformation instead of discrete cosine transformation when transforming the second error signal into a signal of the frequency domain. Thereby, coding at high speed with a small amount of calculation can be achieved.

It is possible to coding the second error signal so as to obtain the stochastic elements as a result of transforming the second error signal into a signal of a frequency domain, selecting a predetermined number of frequencies, at which frequencies the signal transformed to the frequency domain has the maximum spectrum intensity, the second spectrum intensity, . . . , and codes the selected frequencies and the spectrum coefficients at the selected frequencies. Thereby, coding of coefficients of the frequency domain can be performed with a small amount of calculation.

It is also possible to code the second error signal so as to obtain the stochastic elements as a result of selecting a predetermined number of samples, which have the maximum intensity, the second spectrum intensity, . . . , respectively, and code the positions of the selected samples and the intensities of the samples. Thereby, coding of the second error signal can be performed with a small amount of calculation.

It is possible to code the second error signal so as to obtain the stochastic elements as a result of selecting some samples, which have the maximum intensity, the second spectrum intensity, . . . , respectively, and code the positions of the selected samples and the intensities of the samples, and also, transforming the second error signal into a signal of a frequency domain, selecting some frequencies, at which frequencies the signal transformed to the frequency domain has the maximum spectrum intensity, the second spectrum intensity, . . . , and code the selected frequencies and the spectrum coefficients at the selected frequencies. Thereby, coding is performed in which characteristics in the time domain and characteristics in the frequency domain of the second error signal are combined. Accordingly, decoded speech having a high sound quality can be obtained with the same bit rate.

It is also possible to code the second error signal so as to obtain the stochastic elements as a result of selecting a predetermined number of samples, which have the maximum intensity, the second spectrum intensity, . . . , respectively, and code the positions of the selected samples and the intensities of the samples, and also, transforming the second error signal into a signal of a frequency domain, selecting a predetermined number of frequencies, at which frequencies the signal transformed to the frequency domain has the maximum spectrum intensity, the second spectrum intensity, . . . , and code the selected frequencies and the spectrum coefficients at the selected frequencies. Thereby, coding is performed in which characteristics in the time domain and characteristics in the frequency domain of the second error signal are combined. Accordingly, decoded speech having a high sound quality can be obtained with the same bit rate.

It is also possible to code the second error signal so as to obtain the stochastic elements as a result of selecting some samples, which have the maximum intensity, the second spectrum intensity, . . . , respectively, and code the positions of the selected samples and the intensities of the samples, and also, transforming the second error signal into a signal of a frequency domain, selecting some frequencies, at which frequencies the signal transformed to the frequency domain has the maximum spectrum intensity, the second spectrum intensity, . . . , and code the selected frequencies and the spectrum coefficients at the selected frequencies, further, selecting a predetermined number of sets of codes from among the thus-obtained sets of the codes so that a resulting decoded speech has minimum distortion. Thereby, decoded speech having high sound quality can be obtained with the same bit rate.

Other objects and further features of the present invention will become more apparent from the following detailed description when read in conjunction with the accompanying drawings.

DETAILED DESCRIPTION OF THE PREFERRED EMBODIMENTS

Figure 1:
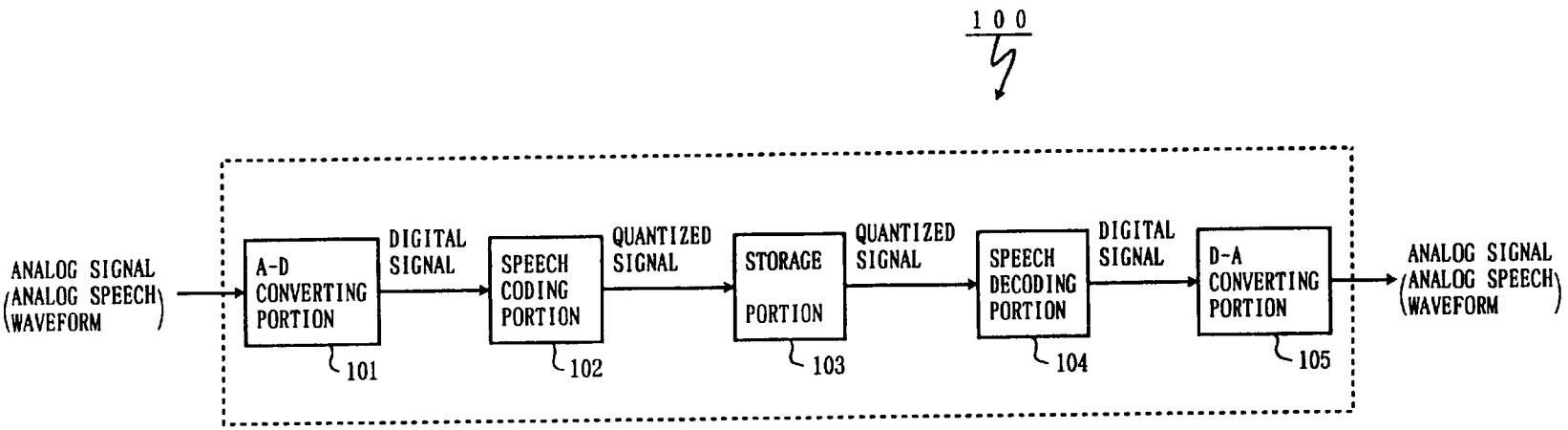
FIG. 1 shows a general block diagram of a speech compression coding device in a first embodiment of the present invention.

FIG. 1 shows a general arrangement of a speech compression coding device 100 in a first embodiment of the present invention. The speech compression coding device 100 includes an A-D converting portion 101, a speech coding portion 102, storage portion 103, a speech decoding portion 104 and a D-A converting portion 105. The A-D converting portion 101 receives an analog signal (analog speech waveform) and converts it into a digital signal (digital speech waveform). The speech coding portion 102 receives the digital signal from the A-D converting portion and compresses and codes the digital signal. The storage portion 103 stores therein the compressed and coded signal. A speech decoding portion 104 decompresses and decodes the compressed and coded signal. The D-A converting portion converts the decoded digital signal into an analog signal.

Figure 2:
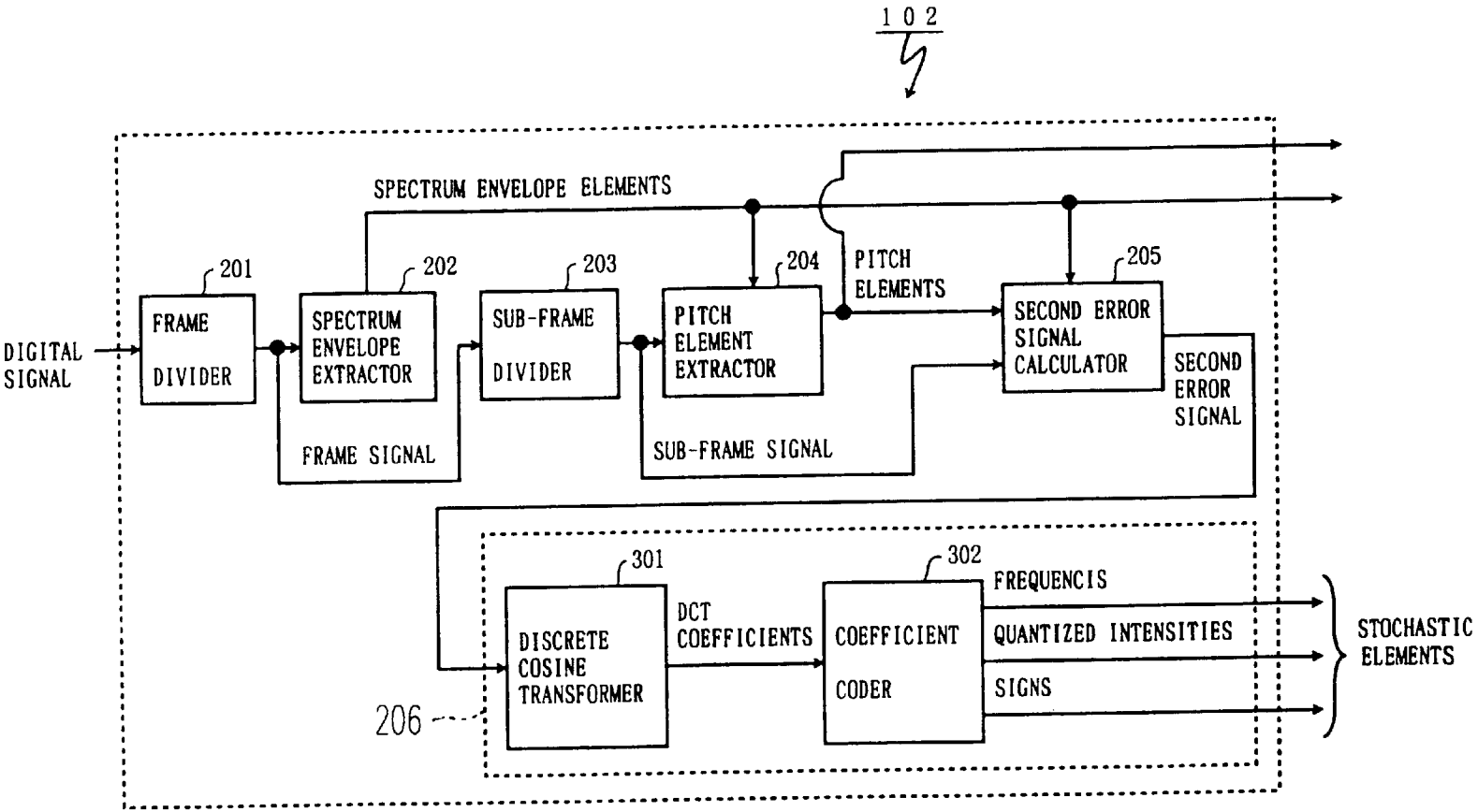
FIG. 2 shows a block diagram of a speech coding portion shown in FIG. 1.

FIG. 2 shows a block diagram of the speech coding portion 102. The speech coding portion 102 includes a frame divider 201, a spectrum envelope extractor 202, a sub-frame divider 203, a pitch element extractor 204, a second error signal calculator 205 and stochastic element extractor 206. The frame divider 201 divides an input digital signal into frames, each frame including a predetermined number of samples, and outputs a frame signal. The spectrum envelope extractor 202 extracts spectrum envelope elements for each frame of the frame signal and codes the extracted spectrum envelope elements. The sub-frame divider 203 divides each frame into sub-frames, each sub-frame including a predetermined number of samples, and outputs a sub-frame signal. The pitch element extractor 204 extracts pitch elements for each sub-frame of the sub-frame signal using the spectrum envelope elements extracted by the spectrum envelope extractor 202. The second error signal calculator 205 receives the pitch elements and the sub-frame signal and calculates a second error signal using the spectrum envelope elements. The stochastic element extractor 206 extracts stochastic elements from the second error signal and codes the stochastic elements.

In detail, with reference to FIG. 1, an analog signal (analog speech waveform) input through an analog speech inputting device (not shown in the figure) is converted into a digital signal through the A-D converting portion 101. As the analog speech inputting device, a microphone, a CD player, a tape deck or the like can be used.

Figure 3:
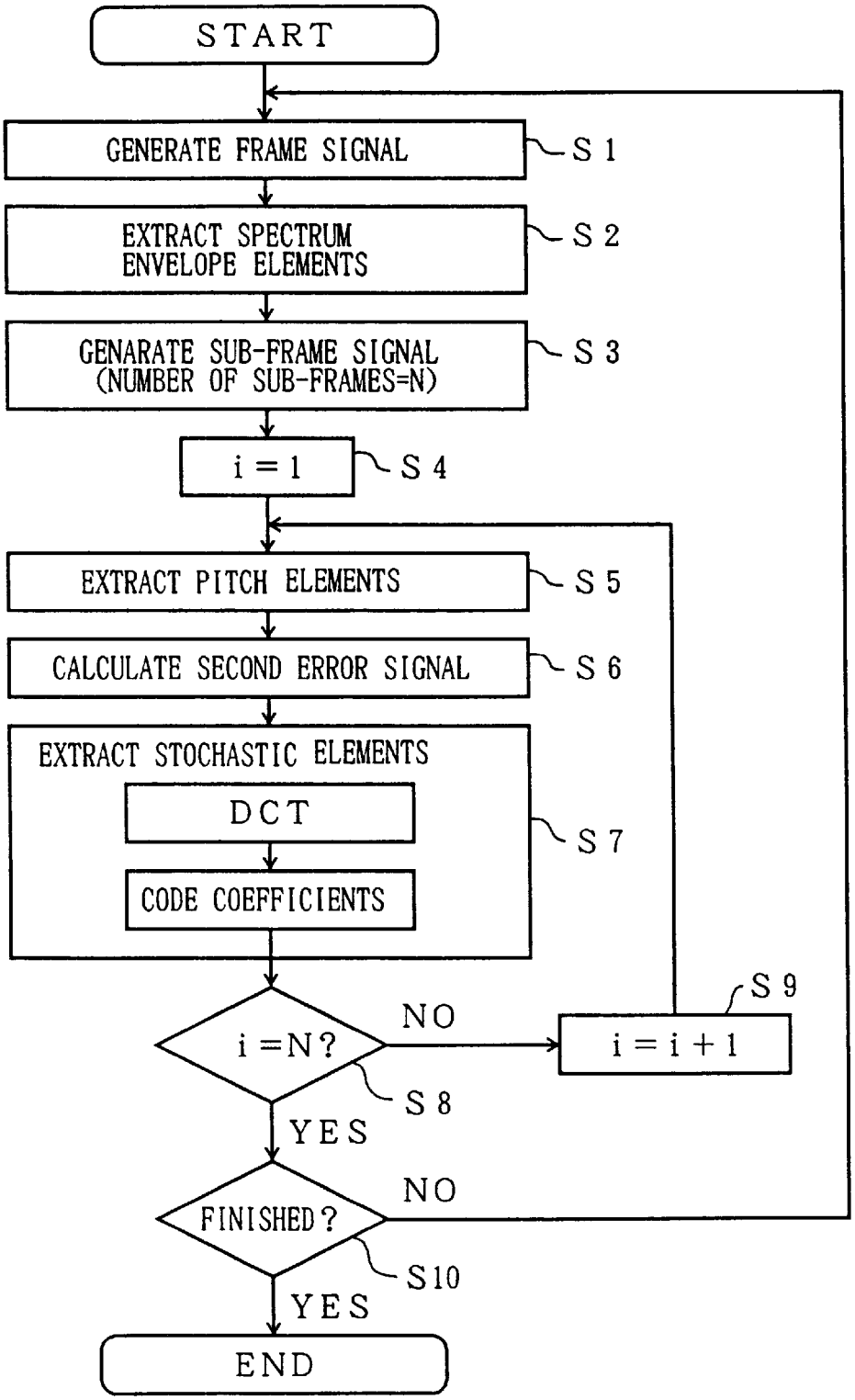
FIG. 3 shows an operation flowchart of processes performed by the speech coding portion.

FIG. 3 shows an operation flowchart of processes performed by the speech coding portion 102.

Then, as shown in FIG. 2, the digital signal is received by the speech coding portion 102, then received by the frame divider 201 and is divided into frame, each frame including a predetermined number (for example, 240) of samples. The frames are provided to the spectrum extractor 202 and the sub-frame divider 203 as the frame signal. Thus, the frame signal is generated by the frame divider 201 in the step S1.

In the step S2, the spectrum envelope extractor 202 extracts spectrum envelope elements for each frame of the frame signal, codes it and provides it to the pitch element extractor 204 and the second error signal calculator 205. As the spectrum envelope elements, LPC (linear Prediction Coding) coefficients based on linear prediction analysis, PARCO coefficients, LSP coefficients or the like can be used. Further, for coding the spectrum envelope elements, vector quantization, scalar quantization, split structured vector quantization, multi-stage vector quantization, predictive quantization, or a combination of a plurality of quantization methods of the above-mentioned quantization can be used.

The sub-frame divider 203 receives the frame signal from the frame divider 201, divides each frame into sub-frames, each sub-frame including a predetermined number (for example, 60) of samples, and outputs the sub-frames as the sub-frame signal. Thus, the sub-frame divider 203 generates the sub-frame signal in the step S3.

In S4, "1" is set in the sub-frame number 'i'.

For each sub-frame, the pitch element extractor 204 extracts pitch elements, in the step S5, and codes them, using the spectrum envelope elements extracted by the spectrum envelope extractor 20 in the step S2. For pitch element extraction, the adaptive codebook search used in the CELP coding system, or spectrum envelope elements of Fourier transformation, Wevelet transformation or the like can be applied. In the adaptive codebook search, a perceptual weighting filter may be used. The perceptual weighting filter may be formed using the above-mentioned LPC coefficients.

In the step S6, the second error signal calculator 205 calculates a component (referred to as 'second error signal') obtained from removing the influence of the pitch component (pitch elements) extracted by the pitch element extractor from the sub-frame signal, for each sub-frame of the sub-frame signal. The calculated second error signal is provided to the stochastic element extractor 206.

The functions of the stochastic element extractor 206 will be described later.

The speech coding method according to the present invention is a coding method belonging to the CELP speech coding system. In the CELP coding system in the prior art, a codebook of a second error signal is provided. A second error signal is synthesized from each code vector of the codebook and the spectrum envelope. Then, the synthesized second error signal is compared with the second error signal obtained from an input signal. The code vector by which distortion of the synthesized second error signal from the second error signal of the input signal is at a minimum is selected. Thus, extracting and coding is performed. In this search, a perceptual weighting filter may be used.

In the CELP coding system in the prior art, a large amount of calculation is needed for the codebook search for the second error signal and also, a memory having a large storage capacity for storing the codebook for the second error signal is needed. In contrast to this, in the first embodiment of the present invention, the second error signal itself is coded, and no codebook search for the second error signal is performed. Thereby, the amount of calculation can be reduced. Further, it is not necessary to provide a codebook for the second error signal, and therefore, it is not necessary to provide a storage capacity of a memory for storing the code book of the second error signal. Thus, it is possible to provide a CELP coding system with a small memory storage capacity.

Thus, the speech coding portion 102 uses the digital signal and extracts the spectrum envelope elements, pitch elements and stochastic elements, and codes them. The thus-obtained information is output as quantized signals. These quantized signals are stored in the storage portion 103 as compressed and coded signals.

The compressed and coded signals (quantized signals) stored in the storage portion 103 are, if necessary, read and decoded by the speech decoding portion 104. The decoded signal is converted into an analog signal (analog speech waveform) by the D-A converting portion 105.

At this time, the speech decoding portion 104 decodes the coded spectrum envelope elements, pitch elements and stochastic elements. From the decoded stochastic elements and pitch elements, the speech decoding portion 104 generates an excitation vector signal. From the excitation vector signal and the decoded spectrum envelope elements, the speech decoding portion 104 generates decoded speech (synthetic speech), and provides it to the D-A converting portion 105.

As described above, in the first embodiment of the present invention, no codebook is provided for the second error signal. Therefore it is possible to reduce a storage capacity of a memory for storing the codebook. Further, codebook search using filter calculation is not performed for the second error signal. Thereby, the amount of calculation can be reduced.

The speech compression coding device in the first embodiment, when coding the second error signal, after transforming the second error signal into a signal of the frequency domain, codes coefficients in the transformed domain, and thus codes the second error signal.

In order to transform the second error signal into a signal of the frequency domain, for example, a discrete cosine transformation, a discrete Fourier transformation or a K-L (Karhunen-Loeve) transformation can be used. In the frequency domain, it is possible to express characteristics of a speech signal by a few parameters. Accordingly, the frequency domain is used in many kinds of speech processing. For example, transformation into the frequency domain, which requires a small amount of calculation, such as fast Fourier transformation, is known. Thus, by transforming the second error signal into the frequency domain and coding coefficients of the transformed domain, it is possible to effectively reduce the amount of calculation.

As shown in FIG. 2, the stochastic element extractor 206 includes a discrete cosine transformer 301 and a coefficient coder 302. The discrete cosine transformer 301 transforms the second error signal provided by the second error signal calculator 205 into a signal of the frequency domain through the discrete cosine transformation (DCT) in S7. The coefficient coder 302 receives coefficients of the frequency domain (DCT coefficient) and codes the coefficients, in step S7.

When coding the coefficients of the transformed domain (the coefficients of the frequency domain), the coefficient coder 302 selects a predetermined number (for example, 2) of frequencies, at which the spectrum intensities are the maximum level, the second level, . . . , respectively, in the signal transformed to the frequency domain. Then, the coefficient coder 302 not only codes the selected frequencies, but also, codes the spectrum coefficients (intensities) at the frequencies as quantized intensities. As a method of coding (quantizing), for example, logarithmic transformation is performed on the amplitudes of the coefficients and codes are given to the transformation results. The codes correspond to previously set scopes. In this case, the numbers given to the selected frequencies, the quantized intensities which are the codes given for the scopes to which the intensities belong to, and signs (±) of the coefficients act as codes (stochastic elements) for the second error signal.

When, on the coding side, the adaptive codebook search is used for the pitch element extraction, the following operation is performed in the stochastic element extractor 206. The respective coefficients are restored from the codes by a coefficient restorer (not shown in the figure), and the restored coefficients are returned to those of the time domain by an inverse discrete cosine transformer (not shown in the figure). Further, a linear prediction inverse filter (not shown in the figure) using the spectrum envelope elements converts the signal returned to the time domain into a residual signal. The residual signal is used as a signal, equivalent to a selected stochastic code vector used in an ordinary CELP coding system, for the adaptive codebook search for the subsequent sub-frame.

In the step S8, it is determined whether or not all the sub-frames have been processed by determining whether or not i=N. If it is determined that all the sub-frames have not been processed, "1" is added to the sub-frame number 'i' in the step S9, and thus, the subsequent sub-frame is processed. If it is determined that all the sub-frames have been processed by determining that i=N, it is determined in the step S10 whether or not the current speech coding process has been finished. If it is determined that the current speech coding process has not been finished, the subsequent frame will be processed in the processes starting from the step S1, until it is determined in the step S10 that the current speech coding process has been finished.

The thus-generated stochastic elements are stored in the storage portion 103.

The speech decoding portion 104 receives, as the stochastic elements, the numbers given to the frequencies, the quantized intensities, and the signs (±). Then, it is necessary to restore the second error signal from the received stochastic elements. For this purpose, the speech decoding portion 104 should restore the DCT coefficients, and also, restore the second error signal from the DCT coefficients.

Figure 4:
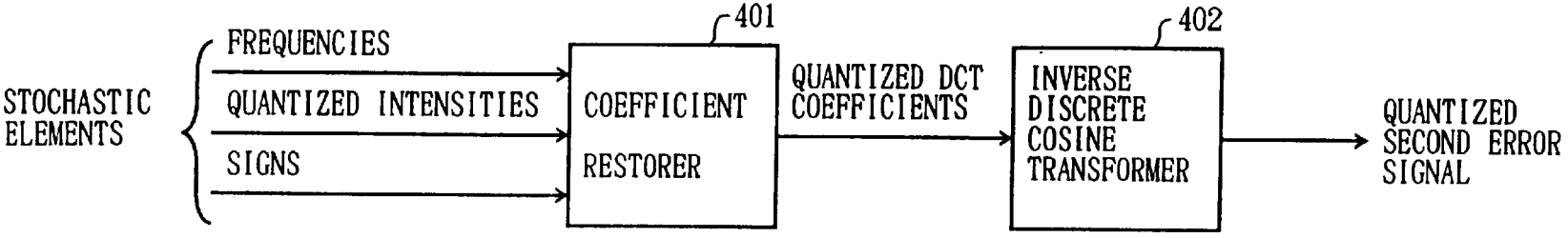
FIG. 4 shows a block diagram of a part of a speech decoding portion shown in FIG. 1.

FIG. 4 shows a part of the speech decoding portion 104. As shown in the figure, the speech decoding portion 104 includes a coefficient restorer 401 and an inverse discrete cosine transformer 402. The coefficient restorer 401 receives the coded coefficients and restores the original coefficients. The inverse discrete cosine transformer 402 returns the restored coefficients from the frequency domain into the time domain. When receiving the stochastic elements from the storage portion 103, the speech decoding portion 104 restores the respective coefficients from the codes of the stochastic elements in the coefficient restorer 401. Then, the inverse discrete cosine transformer 402 returns the restored coefficients from the frequency domain into the time domain. Thus, a quantized second error signal is restored.

When, on the coding side, the adaptive codebook search is used for the pitch element extraction, the following operation is performed in the speech decoding portion 104. The respective coefficients are restored from the codes and the restored coefficients are returned to those of the time domain. Further, a linear prediction inverse filter (not shown in the figure) using the spectrum envelope elements converts the signal returned to the time domain into a residual signal. The residual signal is used as a signal, equivalent to a selected stochastic code vector used in an ordinary CELP coding system, for the adaptive codebook search for the subsequent sub-frame.

Thus, in the first embodiment, frequency characteristics which are characteristics of a speech waveform are coded. Accordingly, with a small number of bits, the second error signal can be coded. Further, the discrete cosine transformation can be performed at high speed by the fast Fourier transformation with a small amount of calculation at high speed. Thus, coding with a small amount of calculation can be achieved.

Further, when coding the coefficients of the transformed domain (the coefficients of the frequency domain), a predetermined number of frequencies, at which the spectrum intensities are at the maximum level, the second level, . . . , respectively, in the signal transformed to the frequency domain, are selected. Then, the selected frequencies and the spectrum coefficients of the selected frequencies are coded. Thus, the second error signal is coded. Accordingly, coding of the second error signal with a small amount of calculation can be achieved.

In the first embodiment, discrete cosine transformation is used for transformation into the frequency domain. However, instead, for the same purpose, discrete Fourier transformation or K-L (Karhunen-Loeve) transformation may be used. Also in this case, coding of the second error signal with a small amount of calculation can be achieved.

Instead of the functions of the stochastic element extractor 206 described above, it is possible that the stochastic element extractor 206 has the following functions.

When receiving the second error signal, the stochastic element extractor 206 directly codes the second error signal, and outputs the coded second error signal (referred to as 'quantized second error signal') as stochastic elements. As a method of coding the second error signal in the stochastic element extractor 206, the following method is applied. A predetermined number of sample positions are selected, at which positions the intensities are at the maximum level, the second level, . . . , respectively, in the second error signal. The selected sample positions and the intensities at the sample positions are coded. By using this method for coding the second error signal, it is possible to reduce the amount or number of calculation.

A speech compression coding device in a second embodiment of the present invention will now be described. In the second embodiment, when coding the second error signal, some samples are selected from the second error signal, which samples have the maximum intensity level, the second intensity level, . . . , respectively. Then, the positions of the selected samples and the amplitude of the samples are coded. Further, the second error signal is transformed into a signal of the frequency domain. Then, some frequencies are selected, at which frequencies the spectrum intensities of the signal transformed to the frequency domain is the maximum level, the second level, . . . , respectively. Then, the selected frequencies and the spectrum coefficients of the selected frequencies are coded. Thus, the second error signal is coded.

Figure 5:
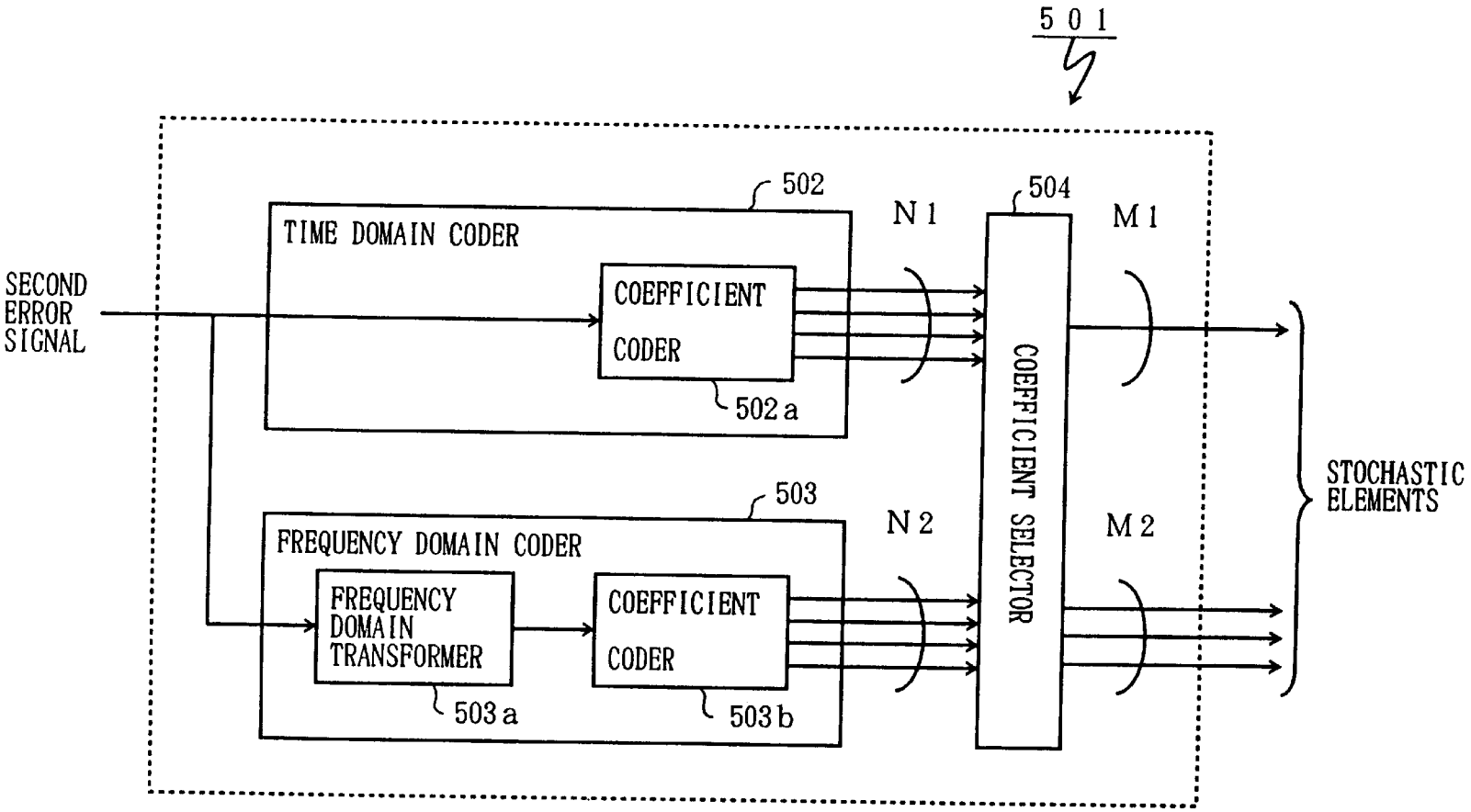
FIG. 5 shows a general block diagram of a stochastic element extractor in a second embodiment of the present invention.

FIG. 5 shows a general block diagram of a stochastic element extractor 501 in the second embodiment. A basic arrangement and operations of the speech compression coding device in the second embodiment is similar to the speech compression coding device in the first embodiment. Accordingly, only a different part will be described.

As shown in FIG. 5, the stochastic element extractor 501 includes a time domain coder 502, a frequency domain coder 503 and a coefficient selector 504. The time domain coder 502 includes a coefficient coder 502*a*. The coefficient coder 502*a* receives the second error signal, selects N1 samples from the second error signal, which samples have the maximum intensity level, the second intensity level, . . . , respectively, and codes the positions of the samples and the intensities of the samples. The frequency domain coder 503 includes a frequency domain transformer 503*a* and a coefficient coder 503*b*. The frequency domain transformer 503*a* receives the second error signal and transforms the second error signal into a signal of the frequency domain. The coefficient coder 503*b* selects N2 frequencies, at which frequencies the signal transformed to the frequency domain has the maximum spectrum intensity, the second spectrum intensity, . . . , respectively, and codes the frequencies and the spectrum coefficients at the frequencies. The coefficient selector 504 selects M1 sets of codes from the N1 sets of codes provided by the time domain coder 502 and selects M2 sets of codes from the N2 sets of codes provided by the frequency domain coder 503. The numbers M1 and M2 are such that M1+M2=M, where the number M is a predetermined number.

The numbers N1 and N2 can appropriately vary depending on the waveform of the second error signal and the coefficients of the signal transformed to the frequency domain, according to predetermined conditions.

The time domain coder 502 selects N1 samples from the second error signal, which samples have the maximum intensity level, the second intensity level, . . . , respectively, codes the positions of the samples and the intensities of the samples, and provides them to the coefficient selector 504.

The frequency domain coder 503 transforms the second error signal into a signal of the frequency domain, selects N2 frequencies, at which frequencies the signal transformed to the frequency domain has the maximum spectrum intensity level, the second spectrum intensity level, . . . , respectively, codes the frequencies and the spectrum coefficients at the frequencies, and provides them to the coefficient selector 504.

The coefficient selector 504 selects M1 sets of codes from the N1 sets of codes provided by the time domain coder 502 and selects M2 sets of codes from the N2 sets of codes provided by the frequency domain coder 503. The selection of M1 sets of codes from N1 sets of codes and M2 sets of codes from N2 sets of codes is performed in accordance with a predetermined selection criterion. The numbers M1 and M2 are such that M1+M2=M, where the number M is a predetermined number. The coefficient selector 504 provides the thus-selected codes as data obtained from coding the second error signal (stochastic elements).

Thus, the second embodiment performs coding in which characteristics in the time domain and characteristics in the frequency domain of the secondary error signal are combined. Accordingly, in comparison to the first embodiment, decoded speech in high sound quality can be obtained with the same bit rate.

A speech compression coding device in a third embodiment of the present invention will now be described. An arrangement of the speech compression coding device in the third embodiment is similar to the arrangement of the speech compression coding device in the second embodiment. In the speech compression coding device in the third embodiment, a predetermined number of samples are selected from the second error signal, which samples have the maximum intensity, the second intensity, . . . . Then, the positions of the selected samples and the amplitudes of the selected samples are coded. Further, the second error signal is transformed into a signal of the frequency domain, and a predetermined number of frequencies are selected, at which frequencies, the signal transformed into the frequency domain has the maximum spectrum intensity, the second spectrum intensity, . . . , respectively. The selected frequencies and the spectrum coefficients at the selected frequencies are coded. Thus, the second error signal is coded.

Specifically, in the stochastic element extractor 501 in the second embodiment shown in FIG. 5, the number N1 of samples selected in the time domain coder 502 and the number N2 of frequencies selected in the frequency domain coder 503 are fixed.

Thus, similar to the second embodiment, the third embodiment performs coding in which characteristics in the time domain and characteristics in the frequency domain of the secondary error signal are combined. Accordingly, in comparison to the first embodiment, decoded speech having a high sound quality can be obtained with the same bit rate.

A speech compression coding device in a fourth embodiment will now be described. An arrangement of the speech compression coding device in the fourth embodiment is similar to the arrangement of the speech compression coding device in the second embodiment. In the speech compression coding device in the fourth embodiment, some samples are selected from the second error signal, which samples have the maximum intensity, the second intensity, . . . . Then, the positions of the selected samples and the amplitudes of the selected samples are coded. Further, the second error signal is transformed into a signal of the frequency domain, and some frequencies are selected, at which frequencies, the signal transformed into the frequency domain has the maximum spectrum intensity, the second spectrum intensity, . . . , respectively. The selected frequencies and the spectrum coefficients at the selected frequencies are coded. Then, a predetermined number of sets of codes are selected from the thus-obtained sets of codes, where a combination of sets of codes to be finally selected is determined so that the resulting decoded speech has a minimum distortion. Thus, the second error signal is coded. In other words, the number of coefficients to be selected in the time domain and the number of coefficients to be selected in the frequency domain of the second error signal and also which coefficients are selected are adjusted so that the resulting decoded speech has the minimum distortion.

Specifically, in the stochastic element extractor 501 in the second embodiment shown in FIG. 5, for all possible combinations of numbers M1 and M2 and also for all possible combinations of M1 sets of codes from the N1 sets of codes and M2 sets of codes from N2 sets of codes for each combination of M1 and M2, distortion of the resulting decoded speech from the input speech is calculated. The numbers M1, M2 and M1 sets of codes and M2 sets of codes are selected so that the distortion is minimum. Thus, M1 sets of codes and M2 sets of codes are obtained and the second error signal is coded. In this case, it is necessary to code the information indicating the thus-obtained combination of the number of M1 and M2. For this purpose, when the number M is 2 or 3, the number of bits to be increased is on the order of 2 for each sub-frame.

Thus, similar to the second embodiment, the fourth embodiment performs coding in which characteristics in the time domain and characteristics in the frequency domain of the secondary error signal are combined. Accordingly, in comparison to the first embodiment, decoded speech having a high sound quality can be obtained with a slight increase of bit rate.

Further, as described above, in the fourth embodiment, the number of coefficients to be selected in the time domain and the number of coefficients to be selected in the frequency domain of the second error signal, and which coefficients are selected are adjusted so that the resulting decoded speech has a minimum distortion. Accordingly, in comparison to the second embodiment, decoded speech in high sound quality can be obtained with slight increase of bit rate.

Figure 6:
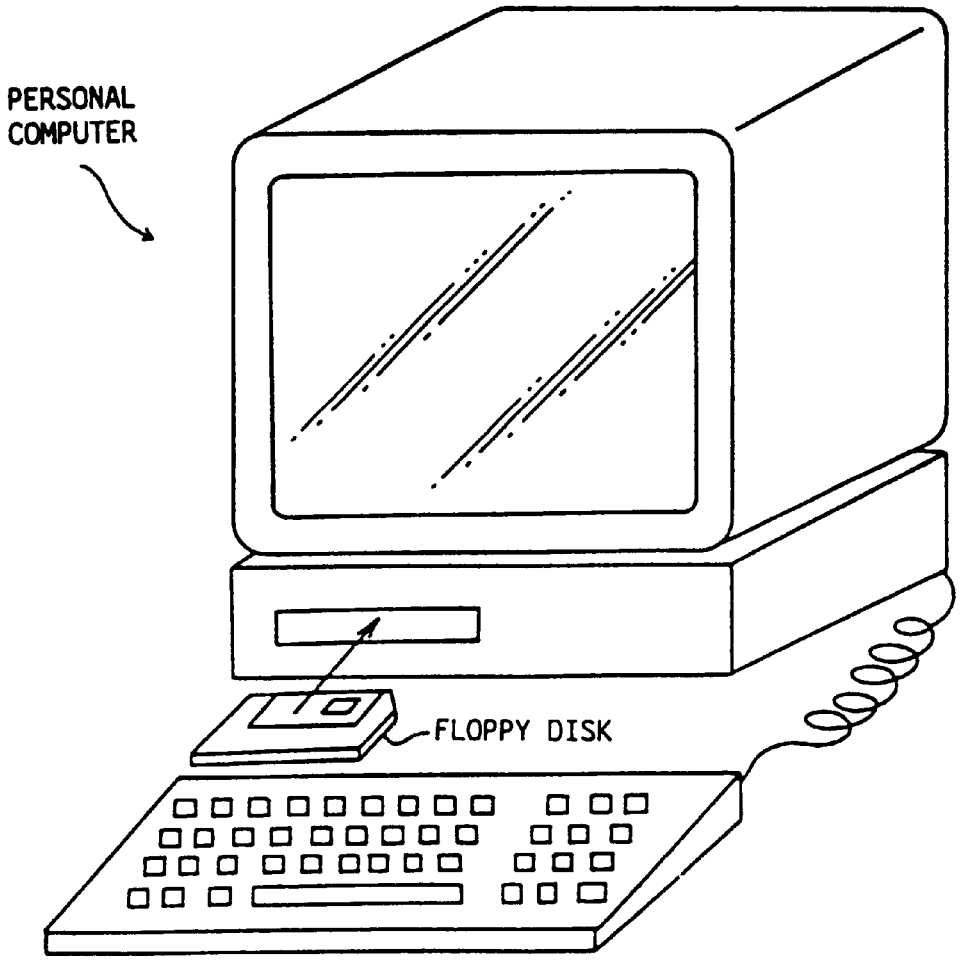
FIG. 6 (PRIOR ART)
FIG. 6 shows an appearance of a personal computer and floppy disk by which each embodiment of the present invention can be practiced.

Each of the above-described embodiments can be practiced using a general purpose computer, such as a personal computer shown in FIG. 6, that is specially configured by software executed thereby to carry out the functions of the embodiment. The software is stored in an information recording medium such as a floppy disk shown in FIG. 6.

The present invention is not limited to the above-described embodiments, and variations and modifications may be made without departing from the scope of the present invention claimed in the following claims.

What is claimed is:

1. A speech compression coding method, comprising the steps of:

a) dividing a digital speech waveform into frames and sub-frames; and b) extracting and coding spectrum envelope elements, pitch elements and stochastic element from the frames and sub-frames;

wherein said step b) calculates a second error signal as a result of subtracting, from the sub-frames, pitch component speech generated from the pitch elements and spectrum envelope elements to result in said second error signal isolating the stochastic elements from the envelope elements and pitch elements;

and codes the second error signal so as to obtain the stochastic elements as a result of transforming the second error signal into a signal of a frequency domain through a transformation and coding coefficients of the transformed domain.

2. The speech compression coding method according to claim 1, wherein the transformation is a discrete cosine transformation.

3. The speech compression coding method according to claim 1, wherein the transformation is a discrete Fourier transformation.

4. The speech compression coding method according to claim 1, wherein the transformation is a K-L (Karhunen-Loeve) transformation.

5. A speech compression coding method, comprising the steps of:

a) receiving an analog speech waveform and converting said analog speech waveform into a digital speech waveform;

b) coding the digital speech waveform in a predetermined coding method;

c) storing the coded digital speech waveform;

d) retrieving and decoding the stored coded digital speech waveform;

e) converting the decoded digital speech waveform into an analog speech waveform, wherein:

said step b) comprises the steps of:

b1) dividing the digital speech waveform into frames and sub-frames; and b2) extracting and coding spectrum envelope elements, pitch elements and stochastic elements for the frames and sub-frames;

said step d) comprises steps of:

d1) decoding the coded spectrum envelope elements, pitch elements and stochastic elements;

d2) generating an excitation vector signal from the decoded stochastic elements and pitch elements; and d3) generating synthetic speech from the excitation vector signal and the decoded spectrum envelope elements;

wherein:

said step b2) calculates a second error signal as a result of subtracting, from the sub-frames, pitch component speech generated from the pitch elements and spectrum envelope elements to result in said second error signal isolating the stochastic elements from the envelope elements and pitch elements;

and codes the second error signal so as to obtain the stochastic elements as a result of transforming the second error signal into a signal of a frequency domain through a transformation and coding coefficients of the transformed domain.

6. The speech compression coding method according to claim 5, wherein the transformation is a discrete cosine transformation.

7. The speech compression coding method according to claim 5, wherein the transformation is a discrete Fourier transformation.

8. The speech compression coding method according to claim 5, wherein the transformation is a K-L (Karhunen-Loeve) transformation.

9. A speech compression coding method, comprising the steps of:

a) receiving an analog speech waveform and converting said analog speech waveform into a digital speech waveform;

b) coding the digital speech waveform in a predetermined coding method;

c) storing the coded digital speech waveform;

d) retrieving and decoding the stored coded digital speech waveform;

e) converting the decoded digital speech waveform into an analog speech waveform, wherein:

said step b) comprises the steps of:

b1) dividing the digital speech waveform into frames and sub-frames; and b2) extracting and coding spectrum envelope elements, pitch elements and stochastic elements for the frames and sub-frames;

said step d) comprises steps of:

d1) decoding the coded spectrum envelope elements, pitch elements and stochastic elements;

d2) generating an excitation vector signal from the decoded stochastic elements and pitch elements; and d3) generating synthetic speech from the excitation vector signal and the decoded spectrum envelope elements;

wherein:

said step b2) calculates a second error signal as a result of subtracting, from the sub-frames, pitch component speech generated from the pitch elements and spectrum envelope elements to result in said second error signal isolating the stochastic elements from the envelope elements and pitch elements;

and codes the second error signal so as to obtain the stochastic elements as a result of transforming the second error signal into a signal of a frequency domain, selecting a predetermined number N of frequencies, at which frequencies the signal transformed to the frequency domain has spectrum intensity levels from a maximum level through an Nth level, and codes the selected frequencies and the spectrum coefficients at the selected frequencies.

10. A speech compression coding method, comprising the steps of:

a) receiving an analog speech waveform and converting said analog speech waveform into a digital speech waveform;

b) coding the digital speech waveform in a predetermined coding method;

c) storing the coded digital speech waveform;

d) retrieving and decoding the stored coded digital speech waveform;

e) converting the decoded digital speech waveform into an analog speech waveform, wherein:

said step b) comprises the steps of:

b1) dividing the digital speech waveform into frames and sub-frames; and b2) extracting and coding spectrum envelope elements, pitch elements and stochastic elements for the frames and sub-frames;

said step d) comprises steps of:

d1) decoding the coded spectrum envelope elements, pitch elements and stochastic elements;

d2) generating an excitation vector signal from the decoded stochastic elements and pitch elements; and d3) generating synthetic speech from the excitation vector signal and the decoded spectrum envelope elements;

wherein:

said step b2) calculates a second error signal as a result of subtracting, from the sub-frames, pitch component speech generated from the pitch elements and spectrum envelope elements to result in said second error signal isolating the stochastic elements from the envelope elements and pitch elements;

and codes the second error signal so as to obtain the stochastic elements as a result of selecting a predetermined number N of samples, which have spectrum intensity levels from a maximum level through an Nth level, and codes the positions of the selected samples and the intensities of the samples.

11. A speech compression coding method, comprising the steps of:

a) receiving an analog speech waveform and converting said analog speech waveform into a digital speech waveform;

b) coding the digital speech waveform in a predetermined coding method;

c) storing the coded digital speech waveform;

d) retrieving and decoding the stored coded digital speech waveform;

e) converting the decoded digital speech waveform into an analog speech waveform, wherein:

said step b) comprises the steps of:

b1) dividing the digital speech waveform into frames and sub-frames; and b2) extracting and coding spectrum envelope elements, pitch elements and stochastic elements for the frames and sub-frames;

said step d) comprises steps of:

d1) decoding the coded spectrum envelope elements, pitch elements and stochastic elements;

d2) generating an excitation vector signal from the decoded stochastic elements and pitch elements; and d3) generating synthetic speech from the excitation vector signal and the decoded spectrum envelope elements;

wherein:

said step b2) calculates a second error signal as a result of subtracting, from the sub-frames, pitch component speech generated from the pitch elements and spectrum envelope elements to result in said second error signal isolating the stochastic elements from the envelope elements and pitch elements;

and codes the second error signal so as to obtain the stochastic elements as a result of selecting samples, which have intensity levels from a maximum level through an Nth level, and codes the positions of the selected samples and the intensities of the samples, and also, transforming the second error signal into a signal of a frequency domain, selecting N frequencies, at which frequencies the signal transformed to the frequency domain has spectrum intensity levels from a maximum level through an Nth level, and codes the selected frequencies and the spectrum coefficients at the selected frequencies.

12. A speech compression coding method, comprising the steps of:

a) receiving an analog speech waveform and converting said analog speech waveform into a digital speech waveform;

b) coding the digital speech waveform in a predetermined coding method;

c) storing the coded digital speech waveform;

d) retrieving and decoding the stored coded digital speech waveform;

e) converting the decoded digital speech waveform into an analog speech waveform, wherein:

said step b) comprises the steps of:

b1) dividing the digital speech waveform into frames and sub-frames; and b2) extracting and coding spectrum envelope elements, pitch elements and stochastic elements for the frames and sub-frames;

said step d) comprises steps of:

d1) decoding the coded spectrum envelope elements, pitch elements and stochastic elements;

d2) generating an excitation vector signal from the decoded stochastic elements and pitch elements; and d3) generating synthetic speech from the excitation vector signal and the decoded spectrum envelope elements;

wherein:

said step b2) calculates a second error signal as a result of subtracting, from the sub-frames, pitch component speech generated from the pitch elements and spectrum envelope elements to result in said second error signal isolating the stochastic elements from the envelope elements and pitch elements;

and codes the second error signal so as to obtain the stochastic elements as a result of selecting a predetermined number of samples, which have intensity levels from a maximum level through an Nth level, and codes the positions of the selected samples and the intensities of the samples, and also, transforming the second error signal into a signal of a frequency domain, selecting a predetermined number N of frequencies, at which frequencies the signal transformed to the frequency domain has spectrum intensity levels from a maximum level through an Nth level, and codes the selected frequencies and the spectrum coefficients at the selected frequencies.

13. A speech compression coding method, comprising the steps of:

a) receiving an analog speech waveform and converting said analog speech waveform into a digital speech waveform;

b) coding the digital speech waveform in a predetermined coding method;

c) storing the coded digital speech waveform;

d) retrieving and decoding the stored coded digital speech waveform;

e) converting the decoded digital speech waveform into an analog speech waveform, wherein:

said step b) comprises the steps of:

b1) dividing the digital speech waveform into frames and sub-frames; and b2) extracting and coding spectrum envelope elements, pitch elements and stochastic elements for the frames and sub-frames;

said step d) comprises steps of:

d1) decoding the coded spectrum envelope elements, pitch elements and stochastic elements;

d2) generating an excitation vector signal from the decoded stochastic elements and pitch elements; and d3) generating synthetic speech from the excitation vector signal and the decoded spectrum envelope elements;

wherein:

said step b2) calculates a second error signal as a result of subtracting, from the sub-frames, pitch component speech generated from the pitch elements and spectrum envelope elements to result in said second error signal isolating the stochastic elements from the envelope elements and pitch elements;

and codes the second error signal so as to obtain the stochastic elements as a result of selecting samples, which have intensity levels from a maximum level through an Nth level, and codes the positions of the selected samples and the intensities of the samples, and also, transforming the second error signal into a signal of a frequency domain, selecting N frequencies, at which frequencies the signal transformed to the frequency domain has spectrum intensity levels from a maximum level through an Nth level, and codes the selected frequencies and the spectrum coefficients at the selected frequencies, and, selecting a predetermined number of sets of codes from among the obtained sets of the codes so that a resulting decoded speech has minimum distortion from the input speech.

14. A speech compression coding device, comprising:

a frame dividing portion dividing a digital speech waveform into frames and sub-frames; and an extracting and coding portion extracting and coding spectrum envelope elements, pitch elements and stochastic elements for the frames and sub-frames;

wherein:

said extracting and coding portion calculates a second error signal as a result of subtracting, from the sub-frames, pitch component speech generated from the pitch elements and spectrum envelope elements to result in said second error signal isolating the stochastic elements from the envelope elements and pitch elements;

and codes the second error signal so as to obtain the stochastic elements as a result of transforming the second error signal into a signal of a frequency domain through a transformation and coding coefficients of the transformed domain.

15. The speech compression coding device according to claim 14, wherein the transformation is a discrete cosine transformation.

16. The speech compression coding device according to claim 14, wherein the transformation is a discrete Fourier transformation.

17. The speech compression coding device according to claim 14, wherein the transformation is a K-L (Karhunen-Loeve) transformation.

18. A speech compression coding device, comprising:

an analog-to-digital converting portion receiving an analog speech waveform and converting said analog speech waveform into a digital speech waveform;

a speech coding portion coding the digital speech waveform in a predetermined coding method;

a storage portion storing the coded digital speech waveform;

a speech decoding portion retrieving and decoding the stored coded digital speech waveform;

a digital-to-analog converting portion converting the decoded digital speech waveform into an analog speech waveform, wherein:

said speech coding portion comprises:

a frame dividing portion dividing the digital speech waveform into frames and sub-frames; and an extracting and coding portion extracting and coding spectrum envelope elements, pitch elements and stochastic elements for the frames and sub-frames;

said speech decoding portion comprises:

a decoding portion decoding the coded spectrum envelope elements, pitch elements and stochastic elements;

an excitation vector signal generating portion generating an excitation vector signal from the decoded stochastic elements and pitch elements; and a synthetic speech generating portion generating synthetic speech from the excitation vector signal and the decoded spectrum envelope elements;

wherein:

said extracting and coding portion calculates a second error signal as a result of subtracting, from the sub-frames, pitch component speech generated from the pitch elements and spectrum envelope elements to result in said second error signal isolating the stochastic elements from the envelope elements and pitch elements;

and codes the second error signal so as to obtain the stochastic elements as a result of transforming the second error signal into a signal of a frequency domain through a transformation and coding coefficients of the transformed domain.

19. The speech compression coding device according to claim 18, wherein the transformation is a discrete cosine transformation.

20. The speech compression coding device according to claim 18, wherein the transformation is a discrete Fourier transformation.

21. The speech compression coding device according to claim 11, wherein the transformation is a K-L (Karhunen-Loeve) transformation.

22. A speech compression coding device, comprising:

an analog-to-digital converting portion receiving an analog speech waveform and converting said analog speech waveform into a digital speech waveform;

a speech coding portion coding the digital speech waveform in a predetermined coding method;

a storage portion storing the coded digital speech waveform;

a speech decoding portion retrieving and decoding the stored coded digital speech waveform;

a digital-to-analog converting portion converting the decoded digital speech waveform into an analog speech waveform, wherein:

said speech coding portion comprises:

a frame dividing portion dividing the digital speech waveform into frames and sub-frames; and an extracting and coding portion extracting and coding spectrum envelope elements, pitch elements and stochastic elements for the frames and sub-frames;

said speech decoding portion comprises:

a decoding portion decoding the coded spectrum envelope elements, pitch elements and stochastic elements;

an excitation vector signal generating portion generating an excitation vector signal from the decoded stochastic elements and pitch elements; and a synthetic speech generating portion generating synthetic speech from the excitation vector signal and the decoded spectrum envelope elements;

wherein:

said extracting and coding portion calculates a second error signal as a result of subtracting, from the sub-frames, pitch component speech generated from the pitch elements and spectrum envelope elements to result in said second error signal isolating the stochastic elements from the envelope elements and pitch elements;

and codes the second error signal so as to obtain the stochastic elements as a result of transforming the second error signal into a signal of a frequency domain, selecting a predetermined number N of frequencies, at which frequencies the signal transformed to the frequency domain has spectrum intensity levels from a maximum level through an Nth level, and codes the selected frequencies and the spectrum coefficients at the selected frequencies.

23. A speech compression coding device, comprising:

an analog-to-digital converting portion receiving an analog speech waveform and converting said analog speech waveform into a digital speech waveform;

a speech coding portion coding the digital speech waveform in a predetermined coding method;

a storage portion storing the coded digital speech waveform;

a speech decoding portion retrieving and decoding the stored coded digital speech waveform;

a digital-to-analog converting portion converting the decoded digital speech waveform into an analog speech waveform, wherein:

said speech coding portion comprises:

a frame dividing portion dividing the digital speech waveform into frames and sub-frames; and an extracting and coding portion extracting and coding spectrum envelope elements, pitch elements and stochastic elements for the frames and sub-frames;

said speech decoding portion comprises:

a decoding portion decoding the coded spectrum envelope elements, pitch elements and stochastic elements;

an excitation vector signal generating portion generating an excitation vector signal from the decoded stochastic elements and pitch elements; and a synthetic speech generating portion generating synthetic speech from the excitation vector signal and the decoded spectrum envelope elements;

wherein:

said extracting and coding portion calculates a second error signal as a result of subtracting, from the sub-frames, pitch component speech generated from the pitch elements and spectrum envelope elements to result in said second error signal isolating the stochastic elements from the envelope elements and pitch elements;

and codes the second error signal so as to obtain the stochastic elements as a result of selecting a predetermined number of samples, which have intensity levels from a maximum level through an Nth level, and codes the positions of the selected samples and the intensities of the samples.

24. A speech compression coding device, comprising:

an analog-to-digital converting portion receiving an analog speech waveform and converting said analog speech waveform into a digital speech waveform;

a speech coding portion coding the digital speech waveform in a predetermined coding method;

a storage portion storing the coded digital speech waveform;

a speech decoding portion retrieving and decoding the stored coded digital speech waveform;

a digital-to-analog converting portion converting the decoded digital speech waveform into an analog speech waveform, wherein:

said speech coding portion comprises:

a frame dividing portion dividing the digital speech waveform into frames and sub-frames; and extracting and coding portion extracting and coding spectrum envelope elements, pitch elements and stochastic elements for the frames and sub-frames;

said speech decoding portion comprises:

a decoding portion decoding the coded spectrum envelope elements, pitch elements and stochastic elements;

an excitation vector signal generating portion generating an excitation vector signal from the decoded stochastic elements and pitch elements; and a synthetic speech generating portion generating synthetic speech from the excitation vector signal and the decoded spectrum envelope elements;

wherein:

said extracting and coding portion calculates a second error signal as a result of subtracting, from the sub-frames, pitch component speech generated from the pitch elements and spectrum envelope elements to result in said second error signal isolating the stochastic elements from the envelope elements and pitch elements;

and codes the second error signal so as to obtain the stochastic elements as a result of selecting samples, which have intensity levels from a maximum level through an Nth level, and codes the positions of the selected samples and the intensities of the samples, and also, transforming the second error signal into a signal of a frequency domain, selecting N frequencies, at which frequencies the signal transformed to the frequency domain has spectrum intensity levels from a maximum level through an Nth level, and codes the selected frequencies and the spectrum coefficients at the selected frequencies.

25. A speech compression coding device, comprising:

an analog-to-digital converting portion receiving an analog speech waveform and converting said analog speech waveform into a digital speech waveform;

a speech coding portion coding the digital speech waveform in a predetermined coding method;

a storage portion storing the coded digital speech waveform;

a speech decoding portion retrieving and decoding the stored coded digital speech waveform;

a digital-to-analog converting portion converting the decoded digital speech waveform into an analog speech waveform, wherein:

said speech coding portion comprises:

a frame dividing portion dividing the digital speech waveform into frames and sub-frames; and an extracting and coding portion extracting and coding spectrum envelope elements, pitch elements and stochastic elements for the frames and sub-frames;

said speech decoding portion comprises:

a decoding portion decoding the coded spectrum envelope elements, pitch elements and stochastic elements;

an excitation vector signal generating portion generating an excitation vector signal from the decoded stochastic elements and pitch elements; and a synthetic speech generating portion generating synthetic speech from the excitation vector signal and the decoded spectrum envelope elements;

wherein:

said extracting and coding portion calculates a second error signal as a result of subtracting, from the sub-frames, pitch component speech generated from the pitch elements and spectrum envelope elements to result in said second error signal isolating the stochastic elements from the envelope elements and pitch elements;

and codes the second error signal so as to obtain the stochastic elements as a result of selecting a predetermined number of samples, which have intensity levels from a maximum level through an Nth level, and codes the positions of the selected samples and the intensities of the samples, and also, transforming the second error signal into a signal of a frequency domain, selecting a predetermined number N of frequencies, at which frequencies the signal transformed to the frequency domain has spectrum intensity levels from a maximum level through an Nth level, and codes the selected frequencies and the spectrum coefficients at the selected frequencies.

26. A speech compression coding device, comprising:

an analog-to-digital converting portion receiving an analog speech waveform and converting said analog speech waveform into a digital speech waveform;

a speech coding portion coding the digital speech waveform in a predetermined coding method;

a storage portion storing the coded digital speech waveform;

a speech decoding portion retrieving and decoding the stored coded digital speech waveform;

a digital-to-analog converting portion converting the decoded digital speech waveform into an analog speech waveform, wherein:

said speech coding portion comprises:

a frame dividing portion dividing the digital speech waveform into frames and sub-frames; and an extracting and coding portion extracting and coding spectrum envelope elements, pitch elements and stochastic elements for the frames and sub-frames;

said speech decoding portion comprises:

a decoding portion decoding the coded spectrum envelope elements, pitch elements and stochastic elements;

an excitation vector signal generating portion generating an excitation vector signal from the decoded stochastic elements and pitch elements; and a synthetic speech generating portion generating synthetic speech from the excitation vector signal and the decoded spectrum envelope elements;

wherein:

said extracting and coding portion calculates a second error signal as a result of subtracting, from the sub-frames, pitch component speech generated from the pitch elements and spectrum envelope elements to result in said second error signal isolating the stochastic elements from the envelope elements and pitch elements;

and codes the second error signal so as to obtain the stochastic elements as a result of selecting samples, which have intensity levels from a maximum level through an Nth level, and codes the positions of the selected samples and the intensities of the samples, and also, transforming the second error signal into a signal of a frequency domain, selecting N frequencies, at which frequencies the signal transformed to the frequency domain has spectrum intensity levels from a maximum level through an Nth level, and codes the selected frequencies and the spectrum coefficients at the selected frequencies, further, selecting a predetermined number of sets of codes from among the obtained sets of the codes so that a resulting decoded speech has minimum distortion from the input speech.

27. A computer program product for speech compression coding, comprising:

program code means a) for dividing the digital speech waveform into frames and sub-frames; and program code means b) for extracting and coding spectrum envelope elements, pitch elements and stochastic elements for the frames and sub-frames;

wherein:

said program code means b) calculates a second error signal as a result of subtracting, from the sub-frames, pitch component speech generated from the pitch elements and spectrum envelope elements to result in said second error signal isolating the stochastic elements from the envelope elements and pitch elements;

and codes the second error signal so as to obtain the stochastic elements as a result of transforming the second error signal into a signal of a frequency domain through a transformation and coding coefficients of the transformed domain.

28. The computer program product for speech compression coding according to claim 27, wherein the transformation is a discrete cosine transformation.

29. The computer program product for speech compression coding according to claim 27, wherein the transformation is a discrete Fourier transformation.

30. The computer program product for speech compression coding according to claim 27, wherein the transformation is a K-L (Karhunen-Loeve) transformation.

31. A computer program product for speech compression coding, comprising:

a computer usable medium having computer readable program code means embodied in said medium, said computer readable code means comprising:

program code means a) for receiving an analog speech waveform and converting said analog speech waveform into a digital speech waveform;

program code means b) for coding the digital speech waveform in a predetermined coding method;

program code means c) for storing the coded digital speech waveform;

program code means d) for retrieving and decoding the stored coded digital speech waveform;

program code means e) for converting the decoded digital speech waveform into an analog speech waveform, wherein:

said program code means b) comprises:

program code means b1) for dividing the digital speech waveform into frames and sub-frames; and program code means b2) for extracting and coding spectrum envelope elements, pitch elements and stochastic elements for the frames and sub-frames;

said program code means d) comprises:

program code means d1) for decoding the coded spectrum envelope elements, pitch elements and stochastic elements;

program code means d2) for generating an excitation vector signal from the decoded stochastic elements and pitch elements; and program code means d3) for generating synthetic speech from the excitation vector signal and the decoded spectrum envelope elements;

wherein:

said program code means b2) calculates a second error signal as a result of subtracting, from the sub-frames, pitch component speech generated from the pitch elements and spectrum envelope elements to result in said second error signal isolating the stochastic elements from the envelope elements and pitch elements;

and codes the second error signal so as to obtain the stochastic elements as a result of transforming the second error signal into a signal of a frequency domain through a transformation and coding coefficients of the transformed domain.

32. The computer program product for speech compression coding according to claim 31, wherein the transformation is a discrete cosine transformation.

33. The computer program product for speech compression coding according to claim 31, wherein the transformation is a discrete Fourier transformation.

34. The computer program product for speech compression coding according to claim 31, wherein the transformation is a K-L (Karhunen-Loeve) transformation.

35. A computer program product, for speech compression coding, comprising:

a computer usable medium having computer readable program code means embodied in said medium, said computer program code means comprising:

program code means a) for receiving an analog speech waveform and converting said analog speech waveform into a digital speech waveform;

program code means b) for coding the digital speech waveform in a predetermined coding method;

program code means c) for storing the coded digital speech waveform;

program code means d) for retrieving and decoding the stored coded digital speech waveform;

program code means e) for converting the decoded digital speech waveform into an analog speech waveform, wherein:

said program code means b) comprises:

program code means b1) for dividing the digital speech waveform into frames and sub-frames; and program code means b2) for extracting and coding spectrum envelope elements, pitch elements and stochastic elements for the frames and sub-frames;

said program code means d) comprises:

program code means d1) for decoding the coded spectrum envelope elements, pitch elements and stochastic elements;

program code means d2) for generating an excitation vector signal from the decoded stochastic elements and pitch elements; and program code means d3) for generating synthetic speech from the excitation vector signal and the decoded spectrum envelope elements;

wherein:

said program code means b2) calculates a second error signal as a result of subtracting, from the sub-frames, pitch component speech generated from the pitch elements and spectrum envelope elements to result in said second error signal isolating the stochastic elements from the envelope elements and pitch elements;

and codes the second error signal so as to obtain the stochastic elements as a result of transforming the second error signal into a signal of a frequency domain, selecting a predetermined number N of frequencies, at which frequencies the signal transformed to the frequency domain has spectrum intensity levels from a maximum level through an Nth level, and codes the selected frequencies and the spectrum coefficients at the selected frequencies.

36. A computer program product, for speech compression coding, comprising:

a computer usable medium having computer readable program code means embodied in said medium, said computer program code means comprising:

program code means a) for receiving an analog speech waveform and converting said analog speech waveform into a digital speech waveform;

program code means b) for coding the digital speech waveform in a predetermined coding method;

program code means c) for storing the coded digital speech waveform;

program code means d) for retrieving and decoding the stored coded digital speech waveform;

program code means e) for converting the decoded digital speech waveform into an analog speech waveform, wherein:

said program code means b) comprises:

program code means b1) for dividing the digital speech waveform into frames and sub-frames; and program code means b2) for extracting and coding spectrum envelope elements, pitch elements and stochastic elements for the frames and sub-frames;

said program code means d) comprises:

program code means d1) for decoding the coded spectrum envelope elements, pitch elements and stochastic elements;

program code means d2) for generating an excitation vector signal from the decoded stochastic elements and pitch elements; and program code means d3) for generating synthetic speech from the excitation vector signal and the decoded spectrum envelope elements;

wherein:

said program code means b2) calculates a second error signal as a result of subtracting, from the sub-frames, pitch component speech generated from the pitch elements and spectrum envelope elements to result in said second error signal isolating the stochastic elements from the envelope elements and pitch elements;

and codes the second error signal so as to obtain the stochastic elements as a result of selecting a predetermined number of samples, which have spectrum intensity levels from a maximum level through an Nth level, and codes the positions of the selected samples and the intensities of the samples.

37. A computer program product, for speech compression coding, comprising:

a computer usable medium having computer readable program code means embodied in said medium, said computer program code means comprising:

program code means a) for receiving an analog speech waveform and converting said analog speech waveform into a digital speech waveform;

program code means b) for coding the digital speech waveform in a predetermined coding method;

program code means c) for storing the coded digital speech waveform;

program code means d) for retrieving and decoding the stored coded digital speech waveform;

program code means e) for converting the decoded digital speech waveform into an analog speech waveform, wherein:

said program code means b) comprises:

program code means b1) for dividing the digital speech waveform into frames and sub-frames; and program code means b2) for extracting and coding spectrum envelope elements, pitch elements and stochastic elements for the frames and sub-frames;

said program code means d) comprises:

program code means d1) for decoding the coded spectrum envelope elements, pitch elements and stochastic elements;

program code means d2) for generating an excitation vector signal from the decoded stochastic elements and pitch elements; and program code means d3) for generating synthetic speech from the excitation vector signal and the decoded spectrum envelope elements;

wherein:

said program code means b2) calculates a second error signal as a result of subtracting, from the sub-frames, pitch component speech generated from the pitch elements and spectrum envelope elements to result in said second error signal isolating the stochastic elements from the envelope elements and pitch elements;

and codes the second error signal so as to obtain the stochastic elements as a result of selecting samples, which have intensity levels from a maximum level through an Nth level, and codes the positions of the selected samples and the intensities of the samples, and also, transforming the second error signal into a signal of a frequency domain, selecting N frequencies, at which frequencies the signal transformed to the frequency domain has spectrum intensity levels from a maximum level through an Nth level, and codes the selected frequencies and the spectrum coefficients at the selected frequencies.

38. A computer program product, for speech compression coding, comprising:

a computer usable medium having computer readable program code means embodied in said medium, said computer program code means comprising:

program code means a) for receiving an analog speech waveform and converting said analog speech waveform into a digital speech waveform;

program code means b) for coding the digital speech waveform in a predetermined coding method;

program code means c) for storing the coded digital speech waveform;

program code means d) for retrieving and decoding the stored coded digital speech waveform;

program code means e) for converting the decoded digital speech waveform into an analog speech waveform, wherein:

said program code means b) comprises:

program code means b1) for dividing the digital speech waveform into frames and sub-frames; and program code means b2) for extracting and coding spectrum envelope elements, pitch elements and stochastic elements for the frames and sub-frames;

said program code means d) comprises:

program code means d1) for decoding the coded spectrum envelope elements, pitch elements and stochastic elements;

program code means d2) for generating an excitation vector signal from the decoded stochastic elements and pitch elements; and program code means d3) for generating synthetic speech from the excitation vector signal and the decoded spectrum envelope elements;

wherein:

said program code means b2) calculates a second error signal as a result of subtracting, from the sub-frames, pitch component speech generated from the pitch elements and spectrum envelope elements to result in said second error signal isolating the stochastic elements from the envelope elements and pitch elements;

and codes the second error signal so as to obtain the stochastic elements as a result of selecting a predetermined number of samples, which have intensity levels from a maximum level through an Nth level, and codes the positions of the selected samples and the intensities of the samples, and also, transforming the second error signal into a signal of a frequency domain, selecting a predetermined number N of frequencies, at which frequencies the signal transformed to the frequency domain has spectrum intensity levels from a maximum level through an Nth level, and codes the selected frequencies and the spectrum coefficients at the selected frequencies.

39. A computer program product, for speech compression coding, comprising:

a computer usable medium having computer readable program code means embodied in said medium, said computer program code means comprising:

program code means a) for receiving an analog speech waveform and converting said analog speech waveform into a digital speech waveform;

program code means b) for coding the digital speech waveform in a predetermined coding method;

program code means c) for storing the coded digital speech waveform;

program code means d) for retrieving and decoding the stored coded digital speech waveform;

program code means e) for converting the decoded digital speech waveform into an analog speech waveform, wherein:

said program code means b) comprises:

program code means b1) for dividing the digital speech waveform into frames and sub-frames; and program code means b2) for extracting and coding spectrum envelope elements, pitch elements and stochastic elements for the frames and sub-frames;

said program code means d) comprises:

program code means d1) for decoding the coded spectrum envelope elements, pitch elements and stochastic elements;

program code means d2) for generating an excitation vector signal from the decoded stochastic elements and pitch elements; and program code means d3) for generating synthetic speech from the excitation vector signal and the decoded spectrum envelope elements;

wherein:

said program code means b2) calculates a second error signal as a result of subtracting, from the sub-frames, pitch component speech generated from the pitch elements and spectrum envelope elements to result in said second error signal isolating the stochastic elements from the envelope elements and pitch elements;

and codes the second error signal so as to obtain the stochastic elements as a result of selecting samples, which have intensity levels from a maximum level through an Nth level, and codes the positions of the selected samples and the intensities of the samples, and also, transforming the second error signal into a signal of a frequency domain, selecting N frequencies, at which frequencies the signal transformed to the frequency domain has spectrum intensity levels from a maximum level through an Nth level, and codes the selected frequencies and the spectrum coefficients at the selected frequencies, further, selecting a predetermined number of sets of codes from among the obtained sets of the codes so that a resulting decoded speech has minimum distortion from the input speech.

* * * * *